US008596052B2

(12) United States Patent
Vigholm et al.

(10) Patent No.: US 8,596,052 B2
(45) Date of Patent: Dec. 3, 2013

(54) METHOD FOR CONTROLLING A WORKING MACHINE

(75) Inventors: Bo Vigholm, Stora Sundby (SE); Andreas Ekvall, Hallstahammar (SE)

(73) Assignee: Volvo Construction Equipment AB, Eskilstuna (SE)

( * ) Notice: Subject to any disclaimer, the term of this patent is extended or adjusted under 35 U.S.C. 154(b) by 798 days.

(21) Appl. No.: 12/741,417

(22) PCT Filed: Nov. 21, 2007

(86) PCT No.: PCT/SE2007/001027

§ 371 (c)(1), (2), (4) Date: May 5, 2010

(87) PCT Pub. No.: WO2009/067049

PCT Pub. Date: May 28, 2009

(65) Prior Publication Data

US 2010/0263362 A1 Oct. 21, 2010

(51) Int. Cl.
*E02F 9/22* (2006.01)

(52) U.S. Cl.
USPC ..... 60/327; 60/426

(58) Field of Classification Search
USPC ..... 60/459, 420, 422, 484, 426, 327
See application file for complete search history.

(56) References Cited

U.S. PATENT DOCUMENTS

| | | | | |
|---|---|---|---|---|
| 4,379,389 | A | 4/1983 | Liesenser | |
| 5,295,795 | A * | 3/1994 | Yasuda et al. | 417/213 |
| 5,538,149 | A | 7/1996 | Martin | |
| 5,680,760 | A * | 10/1997 | Lunzman | 60/426 |
| 5,701,793 | A * | 12/1997 | Gardner et al. | 91/361 |
| 5,848,531 | A * | 12/1998 | Nakamura et al. | 60/426 |
| 6,282,890 | B1 | 9/2001 | Takano | |
| 6,542,789 | B2 | 4/2003 | Ufheil | |
| 2006/0086088 | A1 * | 4/2006 | Pfaff | 60/420 |
| 2007/0095059 | A1 | 5/2007 | Verkuilen et al. | |

FOREIGN PATENT DOCUMENTS

| | | | |
|---|---|---|---|
| GB | 1288235 | A | 9/1972 |
| JP | 10183693 | A | 7/1998 |
| JP | 2006308053 | A | 11/2006 |
| SE | 4596686 | B | 7/1989 |
| WO | 8505155 | A1 | 11/1985 |

OTHER PUBLICATIONS

Internaitonal Search Report for corresponding International Application PCT/SE2007/001027, Aug. 15, 2008.
Internaitonal Preliminary Report on Patentability for corresponding International Application PCT/SE2007/001027, Feb. 19, 2010.
Supplementary European Search Report for corresponding European App. EP 07 83 5225, Mar. 28, 2011.

* cited by examiner

*Primary Examiner* — Edward Look
*Assistant Examiner* — Logan Kraft
(74) *Attorney, Agent, or Firm* — WRB-IP LLP

(57) ABSTRACT

A method for controlling a working machine including a hydraulic system for controlling a plurality of work functions, including lift and tilt of an implement, includes the steps of determining a maximum pressure of a hydraulic fluid for performing a certain task with the implement individually for at least one of the work functions, and delivering the hydraulic fluid, pressurized at most to the determined maximum pressure, to the work function.

25 Claims, 3 Drawing Sheets

METHOD FOR CONTROLLING A WORKING MACHINE

BACKGROUND AND SUMMARY

The present invention relates to a method for controlling a working machine, said working machine comprising a hydraulic system for controlling a plurality of work functions, including lift and tilt of an implement.

Below, the invention will be described in connection with a work vehicle in the form of a wheel loader. This is a preferred, but by no means limiting application of the invention. The invention can for example also be used for other types of working machines (or work vehicles), such as a backhoe loader, an excavator, or an agricultural machine such as a tractor.

A wheel loader can be utilised for a number of fields of activity, such as lifting and transportation of rock and gravel, transport pallets and logs. In each of these activities, different equipment is used, including implements in the form of a bucket, a fork implement and gripping arms. More particularly, the equipment comprises a load-arm unit, or boom, which is pivotally arranged relative to the frame of the wheel loader. Two hydraulic cylinders are arranged between the frame and the load-arm unit in order to achieve a lifting and lowering movement of the load-arm unit. The implement is pivotally arranged on the load-arm unit. An additional hydraulic cylinder is arranged between the implement and the load-arm unit in order to achieve a tilting movement of the implement.

The hydraulic system comprises a pump adapted to supply the hydraulic cylinders with pressurized hydraulic fluid via a hydraulic circuit, comprising a plurality of control valves.

According to prior art, the hydraulic system is load-sensing. According to a previously known such load-sensing system, the maximum available feed pressure is fixed. The maximum feed pressure is then limited either by the pump or by a valve. Furthermore, the hydraulic system is dimensioned for a predetermined highest maximum pressure requirement. In the previously known hydraulic system for wheel loaders, the lifting power can be perceived as too small when the bucket, in a low position, is pushed into a material pile to break out material. In order to solve this, a larger hydraulic cylinder can be used, which then will require a larger pump in order to handle the cylinder speed. The disadvantage is that this means that the system becomes more costly, that it generates more losses in operation and requires a large installation space.

It is desirable to achieve a method for controlling a working machine which, in a cost efficient way, provides an improved operation, particularly with respect to break-out force, preferably with an unchanged or extended service life.

According to an aspect of the present invention, a method comprises determining a maximum pressure of a hydraulic fluid for performing a certain task individually for at least one of the work functions, and supplying the hydraulic fluid, pressurized at most to the determined maximum pressure, to said work function. In this way, a variable maximum pressure, which is demand-controlled for the function, can be obtained.

The requirement of maximum available feed pressure is different depending on the prevailing operating mode, that is to say the function(s) being used, cylinder position, type of implement, handling, etc.

According to a preferred example, the method therefore comprises the step of determining the maximum pressure of the hydraulic fluid individually for the work function based upon the prevailing operating mode. For example, a higher pressure to the lift function can be generated temporarily when the bucket, in a low position, is pushed into a material pile to break out material. Accordingly, the lift cylinder requires a high pressure when it is retracted (penetration into the pile) and a lower pressure when it is extended, which is good from a strength point of view, since cylinders are most sensitive in the extended position.

According to one example, the method comprises the step of continuously determining whether a maximum pressure only at a level below a basic level for the maximum pressure is required to the function and lowering the level of the maximum pressure to the level below the basic level if only the lower maximum pressure level is required. In this way, the lowest possible maximum pressure can be maintained in as many operating modes as possible and thus a long service life can be obtained.

According to one example, the method comprises the step of detecting at least one operating parameter and determining the maximum pressure of the hydraulic fluid individually for the work function based upon the value of the detected operating parameter. The operating parameter then comprises, for example, an operating parameter which is indicative of cylinder position, type of implement, handling being performed, etc. According to one example, the system is adaptive. The control unit can then register how the wheel loader is operated during a certain period of time by detecting operating parameters and make conclusions concerning the handling being performed and/or the type of implement being used. Based thereupon, the control unit can then select a maximum pressure. Alternatively, or as a supplement, the maximum pressure is determined based upon a signal from an operator-controlled element, such as a lever, button or other control means in the cab.

According to another preferred example, the method comprises the steps of determining a maximum pressure of a hydraulic fluid for performing a certain task with the implement individually for at least two of the work functions and delivering the hydraulic fluid, pressurized at most to the determined maximum pressure, to each of said work functions. These work functions include, for example, lift and tilt. The method preferably further comprises the step of supplying the hydraulic fluid, pressurized at most to the determined pressure, simultaneously to each of said work functions.

The hydraulic system is preferably load-sensing. This means that the pump senses the pressure (a LS-signal) from the activated hydraulic cylinders during operation of the system. The pressure signal then originates from pressure sensors which are operatively connected to the hydraulic cylinders. Thereafter, the pump sets a pressure which is a certain number of bar higher than the pressure of the cylinders. This brings about an oil flow out to the hydraulic cylinders, the level of which depends on the extent to which the activated control valve is operated. According to a preferred example, the LS signal is limited depending on the above-mentioned parameters. Only in the case when cooperation between the functions takes place, the valves can limit the maximum pressure in accordance with the above description if a function requires higher pressure. The advantage with limitation primarily by electrical LS is that the losses become lower, since the control pressure for e.g. the lift function is reduced when the lift function is simultaneously stalled.

Further preferred embodiments of the invention and advantages associated therewith are apparent from the following description.

BRIEF DESCRIPTION OF FIGURES

The invention will be described more closely in the following, with reference to the embodiments shown in the attached drawings, wherein.

DETAILED DESCRIPTION

Figure 1:
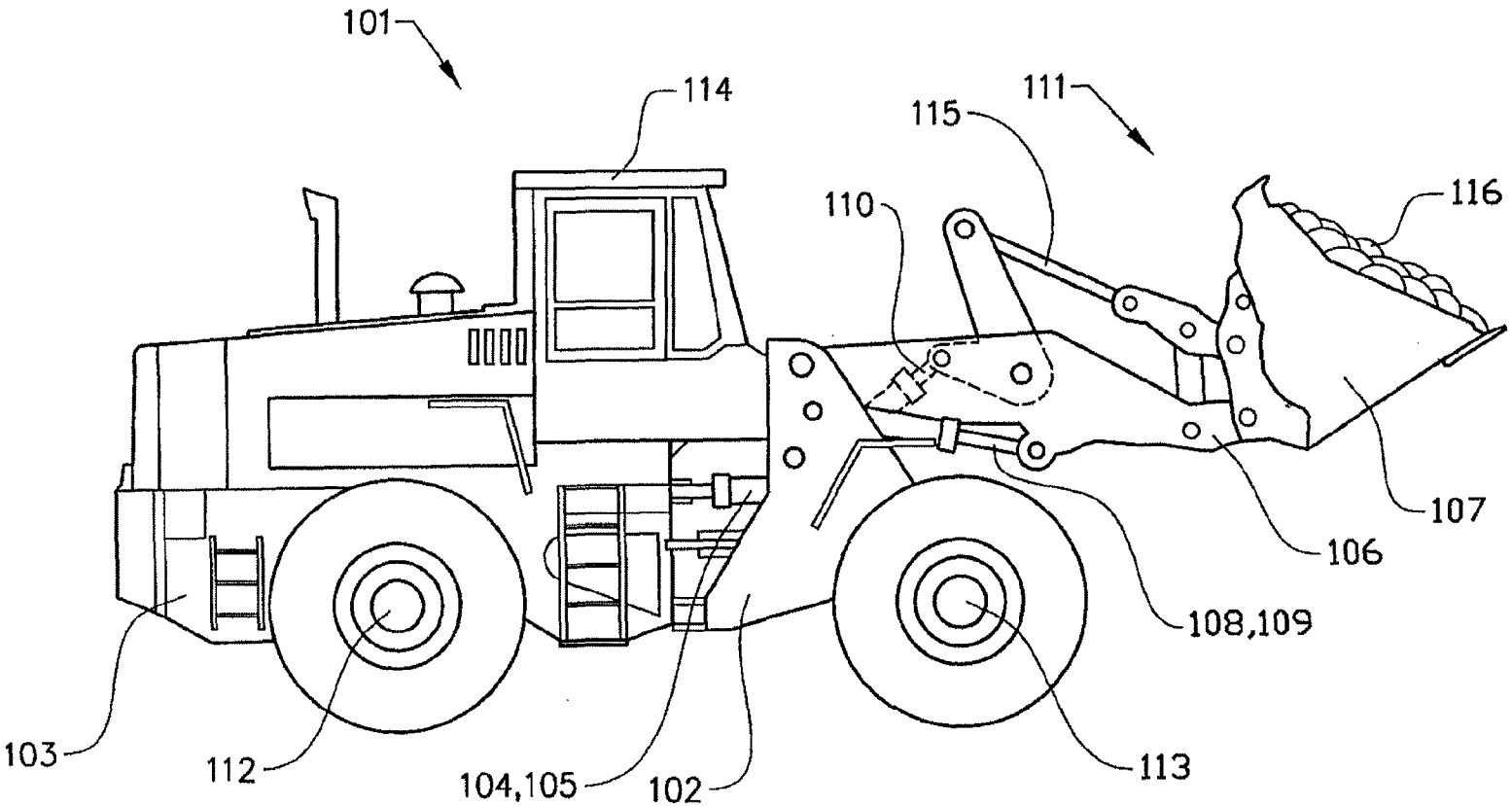
FIG. 1 shows a side view of a wheel loader.

FIG. 1 shows a side view of a wheel loader 101. The wheel loader 101 comprises a front vehicle section 102 and a rear vehicle section 103, said sections each comprising a frame and a pair of drive shafts 112, 113. The rear vehicle section 103 comprises a driver's cab 114. The vehicle sections 102, 103 are connected to each other in such a way that they can be pivoted relative to each other about a vertical axis by means of two actuators in the form of hydraulic cylinders 104, 105, which are connected to the two sections. Accordingly, the hydraulic cylinders 104, 105 are disposed on different sides of a centre line in the longitudinal direction of the vehicle for steering, or turning the wheel loader 101.

The wheel loader 101 comprises an equipment 111 for handling objects or material. The equipment 111 comprises a load-arm unit 106 and an implement 107 in the form of a bucket which is fitted on the load-arm unit. Here, the bucket 107 is filled with material 116. A first end of the load-arm unit 106 is pivotally connected to the front vehicle section 102 in order to achieve a lifting movement of the bucket. The bucket 107 is pivotally connected to a second end of the load-arm unit 106 in order to achieve a tilting movement of the bucket.

The load-arm unit 106 can be raised and lowered relative to the front section 102 of the vehicle by means of two actuators in the form of hydraulic cylinders 108, 109, each of which is connected at one end to the front vehicle section 102 and at the other end to the load-arm unit 106. The bucket 107 can be tilted relative to the load-arm unit 106 by means of a third actuator (hydraulic cylinder) 110, which is connected at one end to the front vehicle section 102 and at the other end to the bucket 107 via a link arm system.

Figure 2:
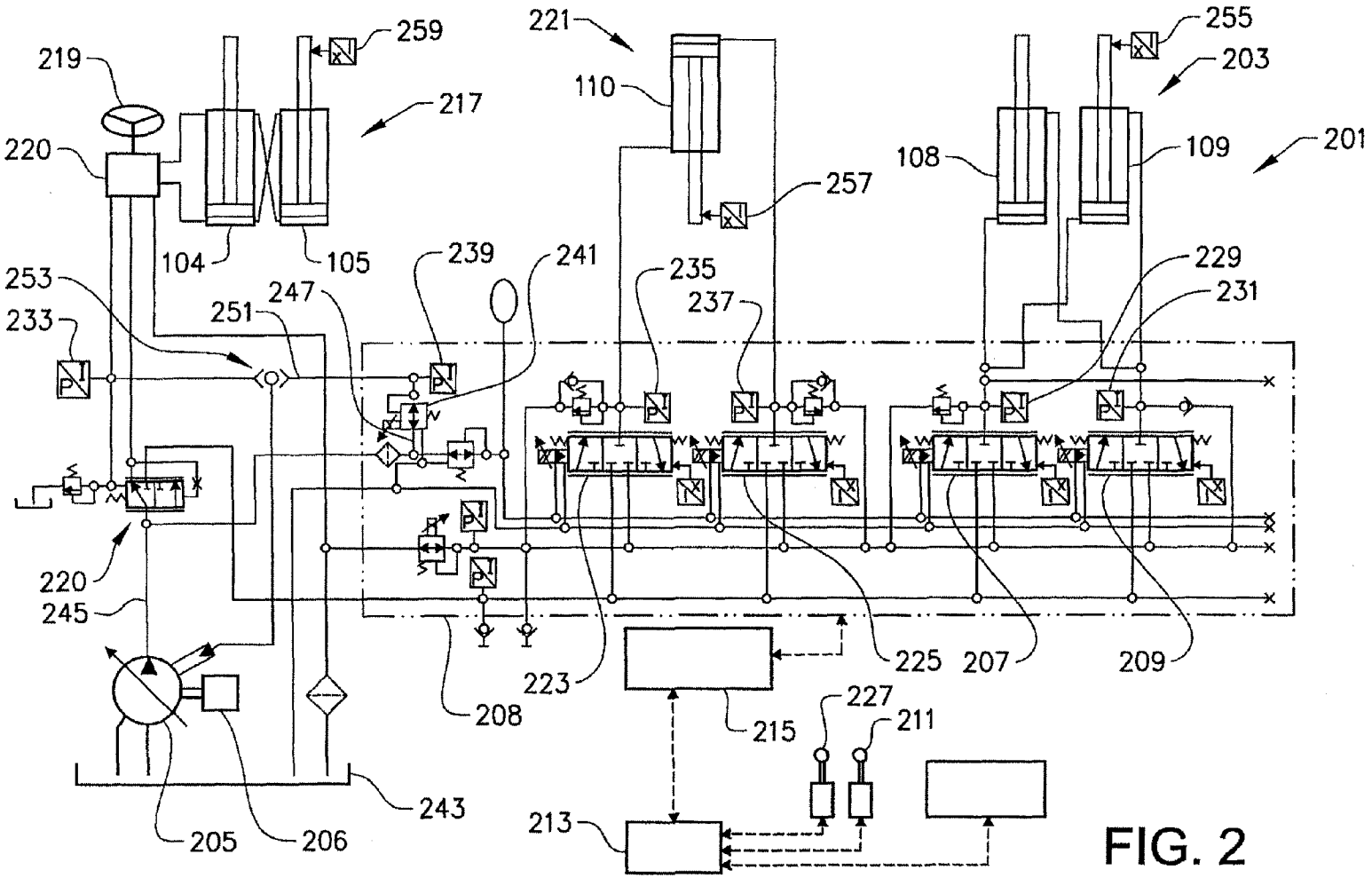
FIG. 2 shows an embodiment of a system for the wheel loader.

A first embodiment of the system is shown in FIG. 2. The system 201 comprises a pump 205 adapted to supply the hydraulic cylinders with pressurized hydraulic fluid via a hydraulic circuit. The pump 205 is driven by the vehicle's propulsion engine 206, in the form of a diesel engine. The pump 205 has a variable displacement. The pump 205 is preferably adapted for infinitely variable control. The system 201 comprises a valve device 208 (se the dash-dotted line), which comprises a hydraulic circuit having a plurality of control valves for controlling the lift and tilt function.

Two control valves, in the form of flow valves, 207, 209, are arranged between the pump 205 and the lift cylinders 108, 109 in the circuit for controlling the lifting and lowering movement. While a first one of these valves 207 is arranged to connect the pump 205 to the piston side, a second one of these valves 209 is arranged to connect a tank 243 to the piston rod side. Furthermore, the first valve 207 is arranged to connect the tank 243 to the piston side and, correspondingly, the second valve 209 is arranged to connect the pump 205 to the piston rod side. This offers large possibilities for varying the control. In particular, it is not necessary to connect the pump and tank simultaneously to the function.

The system 201 further comprises a control unit 213, or computer, which contains software for controlling the functions. The control unit is also called a CPU (central processing unit) or ECM (electronic control module). The control unit 213 suitably comprises a microprocessor.

An operator-controlled element 211, in the form of a lift lever, is operatively connected to the control unit 213. The control unit 213 is adapted to receive control signals from the control lever and to actuate the control valves 207, 209 correspondingly (via a valve control unit 215). The control unit 213 preferably controls more general control strategies and the control unit 215 controls basic functions of the valve unit 208. Naturally, the control units 213, 215 can also be integrated into a single unit. When controlling the pump 205, there is an oil flow out to the cylinders 108, 109, the level of which depends on the extent to which the activated valves 207, 209 are operated.

An operator-controlled element 219, in the form of a steering-wheel, is hydraulically connected to the steering cylinders 104, 105, via a valve unit in the form of an orbitrol unit 220, for direct-control thereof.

Similarly as for the lift function, two control valves 223, 225 are arranged between the pump 205 and the tilt cylinder 110 for controlling the forward and return movement of the implement relative to the load-arm unit. An operator-controlled element 227, in the form of tilt lever, is operatively connected to the control unit 213. The control unit 213 is adapted to receive control signals from the tilt lever and to actuate the control valves 223, 225 correspondingly.

A prioritizing valve 220 is arranged on the outlet conduit 245 from the pump for automatically prioritizing that the steering function receives the required pressure before the lift function (and tilt function).

The system 201 is load-sensing and comprises, for this purpose, a plurality of pressure sensors 229, 231, 233, 235, 237 for detecting load pressures of each of said functions. The lift function of the system comprises two pressure sensors 229, 231, out which one is arranged on a conduit to the piston side of the lift cylinders and the other on a conduit to the piston rod side of the lift cylinders. In a corresponding way, the tilt function of the system comprises two pressure sensors 235, 237, out of which one is arranged on a conduit to the piston rod side of the tilt cylinder and the other on a conduit to the piston side of the tilt cylinder. The steering function comprises a pressure sensor 233 on a conduit connected to the steering cylinders 104, 105. More precisely, the pressure sensor 233 is situated on the LS-conduit which receives the same pressure as on one cylinder side when steering in one direction and as on the other cylinder side when steering in the other direction. In neutral, the LS-conduit is connected to tank.

The system further comprises an electrically controlled valve 241 adapted to control the output pressure of the pump via a hydraulic signal. The system 201 comprises an additional pressure sensor 239 for detecting a pressure which is indicative of an output pressure from the pump. More precisely, the pressure sensor 239 is adapted to detect the pressure in a position downstream the electrically controlled valve 241. Accordingly, the pressure sensor 239 senses the pump pressure directly when the valve 241 is fully open. In normal driving conditions, the pressure sensor 239 detects the modulated pressure from the valve 241. Accordingly, the control unit 213 is adapted to receive a signal from the pump pressure sensor 239 with information about the pressure level.

Accordingly, the control unit 213 receives electrical signals from the pressure sensors 229, 231, 233, 235, 237, 239 and generates an electrical signal for actuating the electrical valve 241.

As previously stated, the control unit 213 is adapted to receive signals from the control levers 211, 227. When the operator desires to lift the bucket, the lift lever 211 is operated. The control unit receives a corresponding signal from the lift lever 211 and actuates the control valves 207, 209 to such a position that the pump is connected to the piston side of the lift cylinders 108, 109 and the piston rod side of the lift cylinders is connected to the tank 243. Furthermore, the control unit receives signals from the load pressure sensor 229 on the piston side of the lift cylinders and from the pressure sensor 239 downstream the pump. Based upon the received signals, a desired pump pressure at a level above the detected load pressure is determined, and the electrically controlled pump control valve 241 is actuated correspondingly.

The control unit 213 is preferably adapted to coordinate the opening degree of the control valves 207, 209, and the output pressure of the pump 205, for optimum operation.

The tilt function is controlled in a corresponding manner as the lift function. When steering the machine, the pressure sensor 233 of the steering function detects a load pressure of the steering and generates a corresponding load signal. The control unit 213 receives this load signal and a signal from the pressure sensor 239 on the outlet conduit of the electrically controlled valve 241. Based upon the received signals, a desired pump pressure at a level above the detected load pressure is determined, and the electrically controlled pump control valve 241 is actuated correspondingly.

When several functions are used simultaneously, the detected load pressures are compared and the pump 205 is controlled corresponding to the highest one of the detected load pressures.

Accordingly, the electrically controlled pump control valve 241 is adapted to be infinitely adjustable between two end positions, a first end position which corresponds to the pump generating a minimum pressure and a second end position which corresponds to the pump generating a maximum pressure.

A hydraulic means 253, in the form of a reversing valve, is arranged on a conduit 251 between the electrically controlled pump control valve 241 and the pump. The reversing valve 253 is adapted to receive the hydraulic signals from the steering function and the pump control valve 241. Furthermore, the reversing valve is adapted to control the pump 205 corresponding to the received signal having the largest load pressure. Accordingly, the hydraulic means (reversing valve) 253 selects the higher pressure in an output signal made up of two input pressure signals.

The system further comprises a sensor 255 for detecting lift cylinder position. The sensor 255 is operatively connected to the control unit 213. In this way, the control unit 213 can decide whether a lifting or lowering movement of the load is performed.

Figure 3:
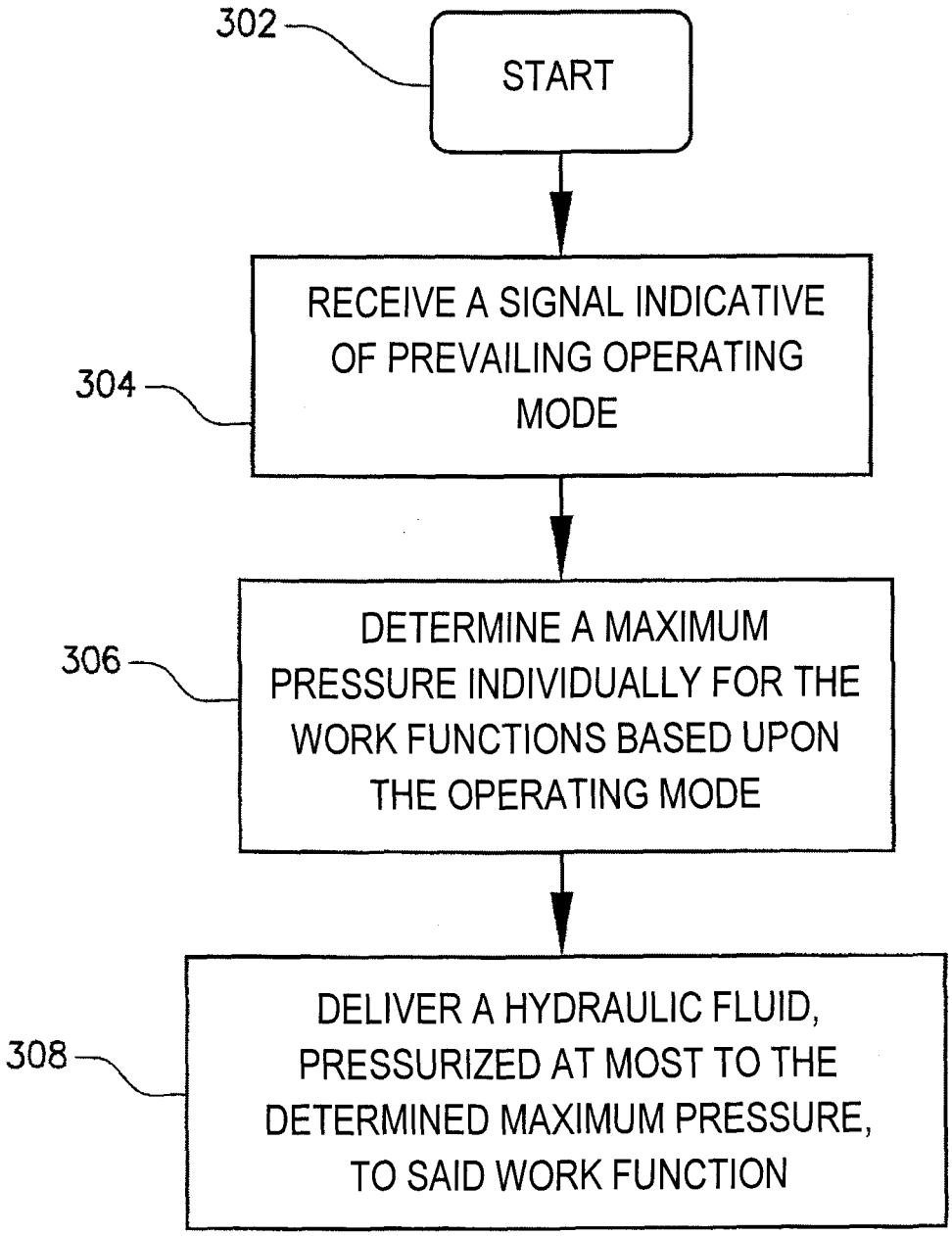
FIG. 3 shows a block diagram for controlling the system according to FIG. 2.

FIG. 3 shows an example of a method for controlling the working machine 101. The method begins in the start box 302. The prevailing operating mode is detected, or determined (see below) and the control unit receives a corresponding signal in the next box 304. The control unit continues to the next box 306 and determines a maximum pressure of a hydraulic fluid for performing a certain task with the implement individually for at least one of the work functions based upon the operating condition. The control unit continues to the next box 308 and ensures that the hydraulic fluid is supplied, pressurized at most to the determined maximum pressure, to said work function. According to a first example, the maximum pressure is determined and varied continuously for the work function based upon the requirement. The requirement, in its turn, is different for different operating modes.

According to a first example of an operating mode, an operating parameter which is indicative of a position of the implement is detected. Implement position encompasses tilt position, that is to say orientation relative to the boom (which can be determined by detecting tilt cylinder position), height position, that is to say the orientation of the boom in the height direction relative to the frame of the wheel loader (which can be determined by detecting lift cylinder position) and/or lateral position, that is to say the relative orientation of the vehicle sections 102, 103 of the wheel loader (which can be determined by detecting steering cylinder position).

More particularly, the cylinder position is detected for the function the operator is modulating: for example when breaking out material from a material pile, where the lift requires high pressure since the load-arm unit is at a lower level where the pulling force on the machine counteracts the lifting work. According to an alternative, or variant, the cylinder position is detected for an other function. For the lift function, for example, when breaking out material it is easier to identify that breaking out is performed if both the lift position and the tilt cylinder position are registered. Furthermore, according to another example, the dependence for the lift function when breaking out material can also be a function of the position of the steering cylinder 104, 105. The purpose is to avoid lifting of the rear wheels, which otherwise could slam back into the ground when released. The larger the steering angle, the lower the maximum pressure to the lift function becomes. Accordingly, the operating parameter is detected for a first work function, and the maximum pressure of the hydraulic fluid is determined for a second work function. According to an alternative, instead the position of the body actuated by the cylinders is detected.

The maximum pressure is determined from a single or several of the above-mentioned operating parameters, or a combination thereof. According to a second example, the maximum pressure is determined from a maximum pressure curve as a function of the above-mentioned parameters, and the curve can further have a curve shape which is different depending on additional operating parameters, such as handling being performed, implement being used, and setting of an operator-controlled element (lever deflection).

For example, when performing garbage handling with a bucket, it is desirable to be able to pack the material with the bucket by means of the lowering function, but it is not desirable to lift the front wheels since they are heavy and the operator becomes very shaken up when the front wheels hit the ground. In this handling, the maximum pressure for lowering can be set at a level which is nearly, but not entirely, capable of lifting the machine.

As far as the type of implement is concerned, a relatively low maximum pressure is required for handling with a pallet fork, since this only performs lifting tasks, but bucket handling requires a higher maximum pressure for breaking out material.

As far as the lever response is concerned, the flow to the cylinder is a function of the lever deflection for a load-sensing system. However, the lever deflection can simultaneously also be maximum force-regulating, that is to say, the maximum pressure increases the larger the lever deflection is.

The dependence of the maximum pressure curve of handling, implement and lever deflection can be registered in the control unit via a button/knob on the panel, or any other system which automatically registers it.

The main valves 207, 209, 223, 225 for each function are used both for flow control and as pressure reducers, which is regulated via the control unit 213. When there is flow out to the cylinder 108, 109 from the pump 205, the control unit verifies that the pressure does not exceed the maximum pressure via the pressure sensor 229, 231 being in contact with the cylinder in question. When the pressure exceeds the maximum pressure, the valve is closed by the control unit. When, on the other hand, the pressure falls below the maximum pressure, the valve is opened again to the position requested by the operator (provided that no other overriding function desires to actuate the valve differently).

If the foregoing is combined with a variably adjustable load-sensing signal (see above), also the fuel consumption can be influenced. The control unit 213 then limits the maximum modulated pump pressure primarily by limiting the LS signal depending on the above-mentioned parameters. Only in the case when cooperation between the functions takes place, the valves can limit the maximum pressure in accordance with the above description if a function requires higher pressure. The advantage with limitation primarily via an electrical load-sensing signal is that the losses become lower, since the control pressure decreases, for e.g. the tilt function, when the lift function is simultaneously stalled.

The invention should not be regarded as limited to the above-described exemplary embodiments, but a number of further variants and modifications are conceivable within the scope of the following claims. In particular, the preferred embodiments can be combined in a number of different ways.

Furthermore, different, fixed maximum pressure levels can be set for two different work functions. Furthermore, the maximum pressure associated with the work function being performed is then selected.

According to a further example, an operating parameter which is indicative of a load on the working machine is detected. For example, a hydraulic pressure of a work function is detected, that is to say in one of said hydraulic cylinders. Furthermore, the maximum pressure for this work function (or another work function) is determined based upon the detected operating parameter. Accordingly, the maximum pressure to the tilt and/or lift function can be adjusted upwards right at the moment when the implement is pushed into the material pile and is going to break out material.

According to one example, the control method can further comprise the steps of comparing a desired pressure (by the operator) with the determined maximum pressure and delivering the smaller of the desired pressure and the determined maximum pressure of the hydraulic fluid to said work function.

According to an alternative of the example where the maximum pressure is continuously varied for the work function, the maximum pressure is predetermined at a number of different levels and the control unit selects one of these predetermined maximum pressures depending on the operating mode.

The invention claimed is:

1. Method for controlling a working machine, said working machine comprising a hydraulic system for controlling a plurality of work functions including lift and tilt of an implement, wherein the hydraulic system comprises at least one control valve for each function of said plurality of work functions, each control valve being actuated by a control unit, wherein the method comprises:

determining a maximum pressure of a hydraulic fluid for performing a certain task individually for at least one of the work functions;

delivering the hydraulic fluid, pressurized at most to the determined maximum pressure, to said work function; and;

controlling the pressure of the hydraulic fluid being supplied to the work function by using said at least one control valve associated with the work function as a pressure reducer.

2. Method according to claim 1, wherein different maximum pressures of the hydraulic fluid are associated with at least two of the work functions, wherein the method comprises selecting the maximum pressure associated with the work function being performed.

3. Method according to claim 1, comprising determining the maximum pressure of the hydraulic fluid individually for the work function based upon the prevailing operating mode.

4. Method according to claim 1, comprising detecting at least one operating parameter and determining the maximum pressure of the hydraulic fluid individually for the work function based upon the value of the detected operating parameter.

5. Method according to claim 4, comprising detecting the operating parameter of a first work function and determining the maximum pressure of the hydraulic fluid for a second work function.

6. Method according to claim 4, comprising detecting a hydraulic pressure associated with one of said work functions and determining the maximum pressure for one of said work functions based upon the detected operating parameter.

7. Method according to claim 1, comprising detecting an operating parameter which is indicative of a position of the implement and determining the maximum pressure for the work function based upon the detected operating parameter.

8. Method according to claim 1, comprising detecting an operating parameter which is indicative of an orientation of the working machine and determining the maximum pressure for the work function based upon the detected operating parameter.

9. Method according to claim 8, wherein the actuator comprises at least one hydraulic cylinder for each of the work functions lift and tilt, the method comprising detecting an operating parameter which is indicative of a position of the hydraulic cylinder.

10. Method according to claim 1, wherein the hydraulic system comprises at least one hydraulic actuator for controlling each of said work functions.

11. Method according to claim 10, wherein the actuator comprises at least one hydraulic cylinder for each of the work functions lift and tilt.

12. Method according to claim 1, comprising detecting an operating parameter which is indicative of a load on the working machine and determining the maximum pressure for the work function based upon the detected operating parameter.

13. Method according to claim 1, comprising determining the maximum pressure of the hydraulic fluid individually for the work function depending on the handling being performed.

14. Method according to claim 1, comprising determining the maximum pressure of the hydraulic fluid individually for the work function depending on the type of implement.

15. Method according to claim 1, comprising determining the maximum pressure of the hydraulic fluid individually for the work function depending on the type of implement.

16. Method according to claim 1, comprising determining the maximum pressure of the hydraulic fluid individually for the work function depending on a signal from an operator-controlled element.

17. Method according to claim 1, comprising determining whether a maximum pressure at a level above a basic level for the maximum pressure is required to the function and temporarily increasing the level of the maximum pressure to the level above the basic level.

18. Method according to claim 1, comprising continuously determining whether only a maximum pressure at a level below a basic level for the maximum pressure is required to the function and lowering the level of the maximum pressure to the level below the basic level if only the lower maximum pressure level is required.

19. Method according to claim 1, comprising determining a maximum pressure of a hydraulic fluid for performing a certain task with the implement individually for at [east two of the work functions and supplying the hydraulic fluid, pressurized at most to the determined maximum pressure, to each of said work functions.

20. Method according to claim 19, comprising supplying the hydraulic fluid, pressurized at most to the determined pressure, simultaneously to each of said work functions.

21. Method according to claim 1, comprising actuating the control valve via an electrical signal.

22. Method according to claim 1, comprising continuously detecting a hydraulic pressure to the function, comparing the detected pressure with the determined maximum pressure, and interrupting the pressurization of the function when the detected pressure is greater than the determined maximum pressure.

23. Method according to claim 1, wherein the hydraulic system comprises a common pump adapted to supply a plurality of said functions with pressurized hydraulic fluid.

24. Method according to claim 23, comprising controlling the pump via an electrical signal.

25. Method according to claim 23, comprising limiting a maximally modulated pump pressure.

* * * * *